United States Patent [19]

Militano, Jr.

[11] Patent Number: 4,934,643

[45] Date of Patent: Jun. 19, 1990

[54] HOLDER FOR SCREED RAIL

[76] Inventor: Martin T. Militano, Jr., 670 Killingsworth Cir., Vacaville, Calif. 95687

[21] Appl. No.: 334,614

[22] Filed: Apr. 6, 1989

[51] Int. Cl.[5] ..... A47G 29/00

[52] U.S. Cl. ..... 248/124; 248/156; 248/286; 248/287; 249/219.1; 269/71; 269/76; 269/79; 269/206

[58] Field of Search ..... 248/124, 121, 130, 156, 248/425, 183, 278, 279, 284, 286, 287, 290, 295.1, 298, 508; 404/83; 52/365; 249/219.1; 269/71, 76, 79, 203

[56] References Cited

U.S. PATENT DOCUMENTS

| | | | |
|---|---|---|---|
| 3,043,587 | 7/1962 | Underhill | 269/71 |
| 3,185,422 | 5/1965 | Spindler | 248/124 |
| 3,545,710 | 12/1970 | Mooney | 248/183 |
| 3,929,309 | 12/1975 | DeVore | 248/279 X |
| 4,065,085 | 12/1977 | Gellatly | 248/124 |
| 4,234,155 | 11/1980 | Destree | 248/124 X |
| 4,659,054 | 4/1987 | Allen | 249/7 |
| 4,671,477 | 6/1987 | Cullen | 248/130 |
| 4,742,825 | 5/1988 | Freund et al. | 248/124 X |

*Primary Examiner*—Ramon O. Ramirez

*Attorney, Agent, or Firm*—Townsend and Townsend

[57] ABSTRACT

An improved adjustable holder for a screed rail for mounting the rail above the ground so as to eliminate the need for concrete pads which are presently used to support such a screed rail on the ground. The holder includes an upright stake or post having a sleeve adjustably mounted on the post for movement along the post. A bar extends laterally from the sleeve and is coupled thereto by a pivot pin so that the angle of the bar relative to the ground can be adjusted. Once adjusted, the bar is fixedly held in place by a clamping structure including a curved, slotted arm pivotally mounted at one end thereof and coupled near the opposite end to the bar. Slidable members are on the bar for holding the side flanges of the screed rail in place on the bar at the proper positions. Thus, the holder of the present invention has three degrees of freedom, namely vertical movement of the sleeve, pivotal movement of the bar in a vertical plane, and linear movement of the flange holding members on the bar.

15 Claims, 1 Drawing Sheet

HOLDER FOR SCREED RAIL

FIELD OF THE INVENTION

The invention of the present application relates to supports for concrete forms and, more particularly, to an adjustable holder for positioning a screed rail used as a form for making a slab on grade.

DESCRIPTION OF THE INVENTION

Many buildings have a slab on grade which is basically a concrete floor. In preparing to form a slab on grade, screed rails are laid down on the ground and are supported on pads of fresh concrete and tapped down to perfect the flatness with the aid of a transit or laser. Once secured, the pads hold the rails firmly in place.

The pads present problems, however, in that, on the average, it takes four men eight hours to set 200 linear feet of screed rail. They often have to use blocks of wood and wooden wedges to support the screed rails temporarily until concrete stiffeners around the joints and in the middle of the rails are poured. Then, after carefully applying the concrete stiffeners, the workmen must spend time checking and double checking the rails for alignment, for level condition, and for tipping or rocking of the rails until the concrete sets up. On the following day, a workman must spend several hours stripping the temporary blocks from under the rails. Thus, approximately 36 hours of labor must be spent per 200 linear feet of screed rail.

Because of the foregoing drawbacks with the use of a conventional slab on grade form, a need exists for improvements in holders for screed rails to permit the rails to be adjustably positioned quickly and easily so as to cut down on the time and labor involved in forming a slab on grade wall.

The present invention satisfies this need.

DESCRIPTION OF PRIOR ART

The prior art in the area of holders for workpieces includes U.S. Pat. Nos. 3,043,587 and 4,659,054.

U.S. Pat. No. 3,043,587 shows a holder for mounting a printed circuit board on which a post is mounted on the base and the post is in an upright position. A sleeve is adjustably mounted on the post, and a bar is coupled to the sleeve for pivotal movement about an axis defined by a bolt. A pair of gripping members are adjustably mounted on the bar. Thus, the holder of this patent is adjustable and has three degrees of freedom.

U.S. Pat. No. 4,659,054 shows a concrete form having a movable rail above a base. Stakes are on the base for supporting a rail, and the rail is on a support surface such as a subgrade.

SUMMARY OF THE INVENTION

The present invention is directed to an improved adjustable holder for a screed rail for mounting the rail above the ground so as to eliminate the need for concrete pads which are presently used to support such a screed rail on the ground. The holder includes an upright stake or post having a sleeve adjustably mounted on the post for movement along the post. A bar extends laterally from the sleeve and is coupled thereto by a pivot pin so that the angle of the bar relative to the ground can be adjusted. Once adjusted, the bar is fixedly held in place by clamping means including a curved, slotted arm pivotally mounted at one end thereof and coupled near the opposite end to the bar.

Slidable members are on the bar for holding the side flanges of the screed rail in place on the bar at the proper positions. Thus, the holder of the present invention has three degrees of freedom, namely vertical movement of the sleeve, pivotal movement of the bar in a vertical plane, and linear movement of the flange clamping members on the bar.

The present invention permits two workmen to do, on the average, 1,000 linear feet in eight hours of work with no double checking. The only stripping required is to pull three iron stakes per rail.

The primary object of the present invention is to provide an improved holder for screed rail wherein the holder is provided with three degrees of freedom to allow a screed rail coupled thereto to be adjusted quickly and easily and to form one of a group of screed rails in a pattern for making a slab on grade form.

Other objects of this invention will become apparent as the following specification progresses, reference being had to the accompanying drawings for an illustration of the invention.

DETAILED DESCRIPTION OF THE INVENTION

Figure 2:
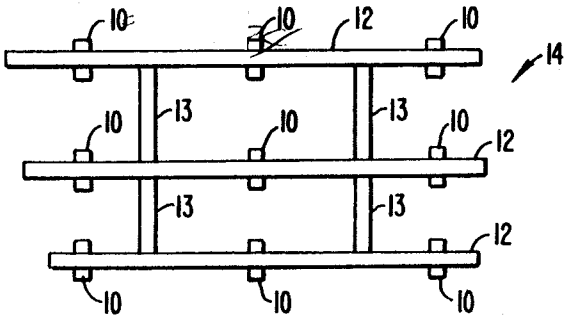
FIG. 2 is a schematic, top plan view of a plurality of screed rails and a number of holders of the present invention coupled with the screed rails for supporting the screed rails in a pattern in which the screed rails are used for forming a slab on grade.

The holder of the present invention is broadly denoted by the numeral 10 and is adapted to support a portion of a screed rail 12 above ground level in a manner to allow the screed rail to form a part of a screed rail pattern, such as pattern 14 shown in FIG. 2, for use in the formation of a concrete slab on grade.

Figure 1:
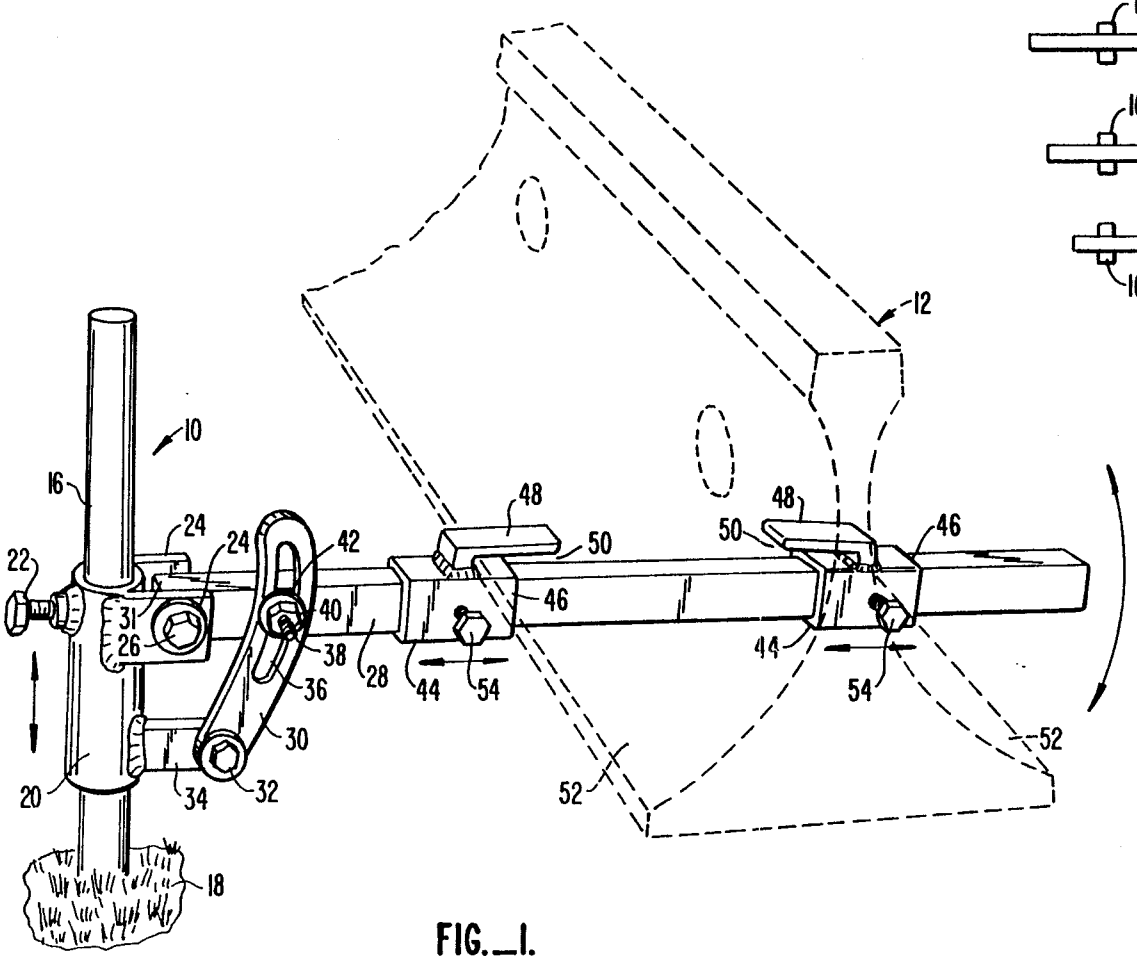
FIG. 1 is a perspective view of the holder of the present invention, showing the holder in an operative position staked into the ground and supporting a screed rail.

The holder 10 includes a post or stake 16 adapted to be driven into or supported on the ground and to extend above ground level 18 as shown in FIG. 1. Stake 16 typically is of a high strength material, such as steel. Typically, the length of the stake is in the range of 18 to 24 inches, but it could be longer or shorter, if desired.

A sleeve 20 of rigid material is slidably mounted on stake 16 and has a set screw 22 for adjustably securing the sleeve at any one of a number of operative positions along the length of stake 16. Thus, sleeve 20 provides a first degree of freedom for holder 10, namely the vertical movement of sleeve 20 along stake 16.

Sleeve 20 has a pair of spaced, generally parallel ears 24 which are welded or otherwise secured to sleeve 20 near the upper end thereof. The ears 24 extend laterally from the sleeve 20 at diametrically opposed locations thereon as shown in FIG. 1. The purpose of ears 24 is to provide a mount for a pin 26, such as a bolt having a head at one end thereof and being threaded at the opposite end thereof for receiving a nut (not shown).

A bar 28 is provided with one end 31 pivotally mounted by pin 26 on ears 24. Bar 28 extends laterally from sleeve 20 and is adapted to extend beneath a screed rail 12 in supporting relationship thereto when the holder 10 is in an operative position as shown in FIG. 1. Typically, bar 28 has a square cross section as shown in FIG. 1 but it can have other cross sections if desired. The bar is typically of a length of 18 to 24 inches.

Pin 26 mounts bar 28 for rotation about the horizontal axis of pin 26 so that holder 10 has a second degree of freedom, namely the pivotal movement of bar 28 about the horizontal axis of pin 26.

To hold bar 28 in any one of a number of pivotal positions with respect to sleeve 20, a curved arm 30 is provided, arm 30 being pivotally mounted by a pin 32 on the outer end of an ear 34 rigidly secured to and extending laterally from sleeve 20 near the lower end thereof. Ear 34 extends laterally from sleeve 20 and is of a length at least equal to that of ears 24. As shown, the length of ear 34 is slightly greater than lengths of ears 24.

Arm 30 has a curved slot 36 therethrough for receiving a pin 38 carried by bar 28, pin 38 being a bolt having a nut 40 adjacent to a washer 42. A head (not shown) is on the opposite end of bolt 38. By tightening nut 40, bar 28 can be held in any one of a number of positions tilted with respect to sleeve 20.

A pair of slidable members 44 are provided on bar 28. Each of slidable members 44 includes a tubular part 46 which has the same cross section as bar 28. An L-shaped element 48 is rigidly secured, such as by welding, to part 46 and extends parallel with bar 28.

A space 50 is between bar 28 and element 48 of each member 44. This space is adapted to receive the adjacent side flange 52 of screed rail 12 to be held by holder 10 in an operative position above the ground. A set screw 54 is threadably coupled to the side of part 46 to releasably and adjustably secure the slidable member 44 in an operative position.

In operation, screed rails 12 and 13 are arranged in a pattern, such as pattern 14 shown in FIG. 2 on the ground. Then, a number of holders 10 are moved into position adjacent to screed rails 12 and the stakes 16 of holders 10 are driven into the ground, following which sleeves 20 are placed over the stakes to position bars 28 below the adjacent screed rails 12 or 13.

For each location at which a holder 10 is located, the adjacent screed rail is placed on the bar 28 with members 44 separated, following which the members are moved onto respective flanges 52 of the screed rail. The set screws 54 are preferably not tightened until the adjustments to the other portions of holder 10 are made.

Sleeve 20 is first adjusted to the proper height so that the bottom of the screed rail will be at a proper height above the ground. Then, set screw 22 on sleeve 20 is tightened. Thereafter, the angle of inclination of bar 28 is adjusted to the proper angular location, following which nut 40 is tightened, clamping member 32 to the side of bar 28. Then, the screed rail 12 is shifted longitudinally of bar 28 until the proper location is found, following which the set screws 54 are tightened to secure the screed rail in place on the bar 28.

All other holders 10 for providing pattern 14 are adjusted in the corresponding manner, following which concrete can be poured over and between the screed rails 12 and 13 of pattern 14 (FIG. 2). As soon as the concrete has set to form a slab, the holders can be separated from the screed rails and the holders may be removed from the ground. The holders 10 are then available for use in forming another wall.

With the holders 10 of the present invention, two workmen can set 1,000 linear feet of screed rail in about 8 hours with no double-checking and the only stripping required is to pull three iron stakes per rail.

I claim:

1. A holder for a screed rail having bottom flange means comprising:
   - a support;
   - a bar;
   - means adjustably mounting one end of the bar on the support for up and down movement with respect thereto, said mounting means including means for pivotally securing said one end of the bar to the support;
   - means pivotally coupled with the bar and the mounting means at locations spaced from said one end of the bar for adjustably securing the bar in any one of a number of angular positions relative to the support; and
   - means movable along the bar for adjustably attaching the flange means of the screed rail thereto.

2. A holder as set forth in claim 1, wherein the mounting means includes, a sleeve, and said pivotal securing means includes an ear on the sleeve and extending laterally therefrom, said one end of the bar having a pin coupled with the ear for pivotally mounting the bar for movement in a generally vertical plane when the post is in an upright position.

3. A holder as set forth in claim 2, wherein said ear is near the upper end of the sleeve.

4. A holder as set forth in claim 1, wherein said pivotal securing means includes an ear secured to and extending laterally from said mounting means, and a pin pivotally mounting said one end of the bar on the ear.

5. A holder as set forth in claim 4, wherein the mounting means includes a sleeve having an upper end, said ear being secured to the sleeve near the upper end thereof.

6. A holder as set forth in claim 5, wherein is included a second ear secured to and extending laterally from the sleeve, said second ear being generally parallel to the first ear to present a space between the ears, said one end of the bar being in the space and pivotally mounted to the ears.

7. A holder for a screed rail having a pair of side flanges comprising:
   - a post adapted to be mounted in an upright position extending above ground level;
   - a sleeve shiftably mounted on the post for movement up and down with respect thereto;
   - a set screw coupled with the sleeve for securing the sleeve to the post, said sleeve having an upper end provided with a pair of spaced, parallel ears extending laterally from the sleeve to present a space between the ears, a third ear being extending laterally from the lower end of the sleeve and being generally parallel with said pair of ears;
   - a bar having a pair of opposed ends, one of the ends being in the space between the pair of ears;
   - pin means pivotally coupling said one end of the bar to the pair of ears with the bar extending outwardly from the ears and movable in a generally vertical plane about the axis of said pin means when the post is in said upright position;
   - an arm having a curved slot therein and provided with a pair of opposed ends, second pin means securing one end of the element to the third ear, there being a third pin means extending through the slot and coupled with the bar for adjustably securing the element to the bar with the bar being in a selected angular position in a vertical plane relative to the sleeve; and a pair of members shiftably mounted on the bar for movement longitudinally thereof, each of the members having an element spaced above the bar for receiving a respective flange of a screed rail, and means for securing the members in fixed positions along the bar.

8. A holder for a screed rail having bottom flange means comprising:

a support;

a bar;

means adjustably mounting one end of the bar on the support for up and down movement with respect thereto, said mounting means including means for pivotally securing said one end of the bar to the support;

a curved arm adjustably coupled with the bar, said arm having an end pivotally coupled with said mounting means, and clamp means for adjustably securing the arm to the bar to thereby adjustably secure the bar in any one of a number of angular positions relative to the support; and means movable along the bar for adjustably attaching the flange means of the screed rail thereto.

9. A holder as set forth in claim 8, wherein said arm includes a rigid body having a slot therethrough, said clamp means including a pin passing through the slot and coupled with the bar, and a nut on the pin for clamping the element to the bar.

10. A holder as set forth in claim 8, wherein said mounting means includes a sleeve, there being an ear secured to and extending laterally from the sleeve, said arm having an end pivotally coupled to the ear.

11. A holder as set forth in claim 10, wherein is included a second ear secured to and extending laterally from the sleeve, the first ear and the second ear being generally parallel with the second ear being above the first ear, said one end of the bar being pivotally coupled to said second ear.

12. A holder for a screed rail having bottom flange means comprising:

a support;

a bar;

means adjustably mounting one end of the bar on the support for up and down movement with respect thereto, said mounting means including means for pivotally securing said one end of the bar to the support;

means coupled with the support for adjustably securing the bar in any one of a number of angular positions relative to the support; and a member slidably coupled to and movable along the bar, said member having an element for overlying the adjacent flange of the screed rail, and means for fixedly securing the member to the bar for adjustably attaching the screed rail thereto.

13. A holder as set forth in claim 12, wherein said member includes a tubular body for receiving the bar, and a set screw for securing the body to the bar.

14. A holder as set forth in claim 13, wherein said bar has a square cross section, said body having a cross section complemental with the bar.

15. A holder as set forth in claim 13, wherein said element is generally L-shaped and has one end secured to and extending outwardly from the body, said element forming with said bar a space for receiving a flange of the screed rail.

* * * * *